US005772167A

United States Patent [19]

Koole

[11] Patent Number: 5,772,167

[45] Date of Patent: Jun. 30, 1998

[54] BASKETBALL-STAND

[75] Inventor: Peter Marinus Koole, Kloetinge, Netherlands

[73] Assignee: Schelde International B.V., Goes, Netherlands

[21] Appl. No.: 681,887

[22] Filed: Jul. 29, 1996

[51] Int. Cl.[6] ..... A63B 63/00

[52] U.S. Cl. ..... 248/284.1; 248/421; 248/188.3; 473/483

[58] Field of Search ..... 248/421, 188.2, 248/284.1, 298.1; 473/481, 483

[56] References Cited

U.S. PATENT DOCUMENTS

| | | | |
|---|---|---|---|
| 3,137,502 | 6/1964 | Duganich | 273/1.5 R |
| 3,841,631 | 10/1974 | Dolan | 248/188.2 |
| 4,330,101 | 5/1982 | Andersen | 248/284.1 |
| 4,412,679 | 11/1983 | Mahoney et al. | 273/1.5 R |
| 5,098,092 | 3/1992 | Aakre et al. | 473/483 |
| 5,100,132 | 3/1992 | Anderson et al. | 273/1.5 R |
| 5,102,128 | 4/1992 | Geise | 473/483 |
| 5,133,547 | 7/1992 | Pardi | 248/284.1 |

OTHER PUBLICATIONS

Basketball Products International, Inc., 95–96 Product Catalog pp. 38–40, Jun. 1995.

*Primary Examiner*—Victor N. Sakran
*Attorney, Agent, or Firm*—Brooks & Kushman P.C.

[57] ABSTRACT

A basketball-stand, comprising a base which carries at least one support system which in turn carries a beam provided with means for attachment of a back-board and dunk ring. The beam comprises two parts—a first part carried by the support system and a second part which carries the means for attachment of a back-board and dunk ring—said first and second parts being movable one with respect to the other such that the effective beam length is adjustable.

Preferably the second beam part is slidable with respect to the first beam part.

In a preferred embodiment the first beam part is provided exteriorly with a stop element for abutment of the outer tube to define one extreme relative position corresponding with the shortest effective beam length, and said first beam part furthermore, at a small distance from its free end, is provided interiorly with an abutment member for a further stop member carried by the second part, to define another extreme relative position, corresponding with the greatest effective beam length.

13 Claims, 7 Drawing Sheets

BASKETBALL-STAND

BACKGROUND

State of the Art

The invention relates to a basketball-stand, comprising a base which carries at least one support system which in turn carries a beam provided with means for attachment of a back-board and dunk ring.

Basketball-stands of this general structure have been known long since, in a plurality of systems and embodiments. Variations are concerned with the nature, and more particularly rigidity of the support system, the presence or absence of a capacity of the beam to be moved between a lower or a storage position and a higher or playing position, including various spring-structures to facilitate the transfer between these positions. Irrespective of these variations it is an essential requirement for the base to stand outside the playing field and for the beam to project into the playing field over a certain distance, which, according to one regulation of the world baseball organization is 120 cms. According to another regulation the base should be placed a certain minimum distance outside the line which defines the playing field, which enables the players to trespass the line while not yet running the risk of bumping against the stand. Under this viewpoint the regulation states that the effective beam length—being defined as the distance between the front of the back-board and the front of the base—should be 325 cms which, in view of the 120 cms which the beam is to project into the field, leaves 205 cms of free space for the players between the inside of the line and the front of the base.

This requires, however, that quite some space be available on either end of the field. For example with an effective length of the base of 185 cms, the regulation can only be met when 390 cms is available.

Quite often the centre court is given sufficient space, but for training courts there is less space available. Therefore manufacturers have produced other baseball-stands with a smaller effective beam length, of 245 cms. These stands, which will be used for training purposes, can not be used at the centre court, or, irrespective of the regulation, simply to give the players more space available.

OBJECTS OF THE INVENTION

The main object of the invention is, therefore, to cope with the above mentioned problem and to develop a basketball-stand which can be used with a smaller as well as with a greater effective beam length.

Another object is to realize this in a manner which allows changing the beam length in a simple and very quick manner.

SUMMARY OF THE INVENTION

According to the invention the beam comprises two parts—a first part carried by the support system and a second part which carries the means for attachment of a back-board and dunk ring—said first and second parts being movable one with respect to the other such that the effective beam length is adjustable.

Preferably the second beam part is slidable with respect to the first beam part.

In a preferred embodiment the first beam part is provided exteriorly with a stop element for abutment of the outer tube to define one extreme relative position corresponding with the shortest effective beam length, and said first beam part furthermore, at a small distance from its free end, is provided interiorly with an abutment member for a further stop member carried by the second part, to define another extreme relative position, corresponding with the greatest effective beam length.

SHORT DESCRIPTION OF THE FIGURES

FIG. 1 represents the state of the art in form of one embodiment of the basketball-stand having a short beam length, and represented in storage position.

FIG. 2 diagrammatically represents the basketball-stand according to this invention, in the same storage position as the one depicted in FIG. 1, indicating in broken lines the extended effective beam length and the position of the back-board and dunk ring obtained thereby.

Figure 5:
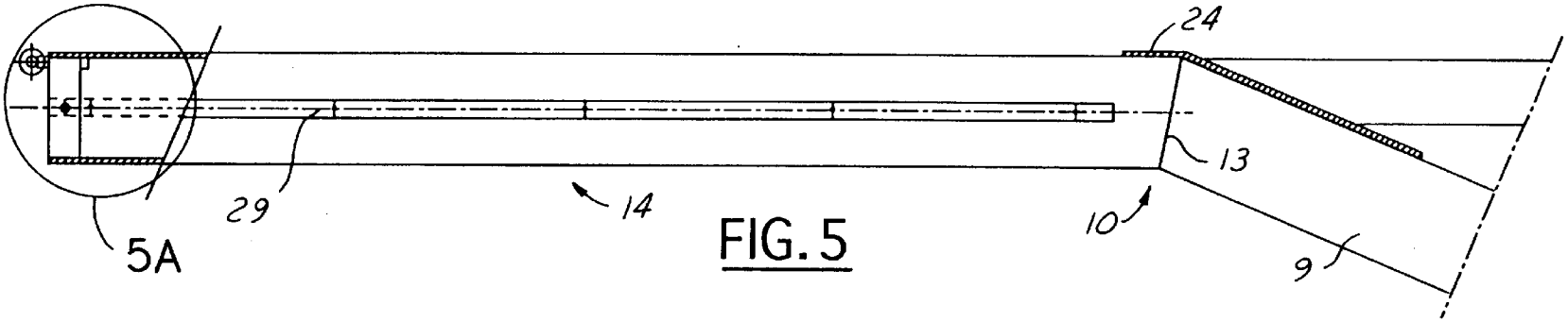
FIG. 5 is an elevational view of part of the beam comprising an inner tube according to the invention partly broken away to show the interior structure, and this part A being shown on an enlarged scale in FIG. 5A.
Figure 7:
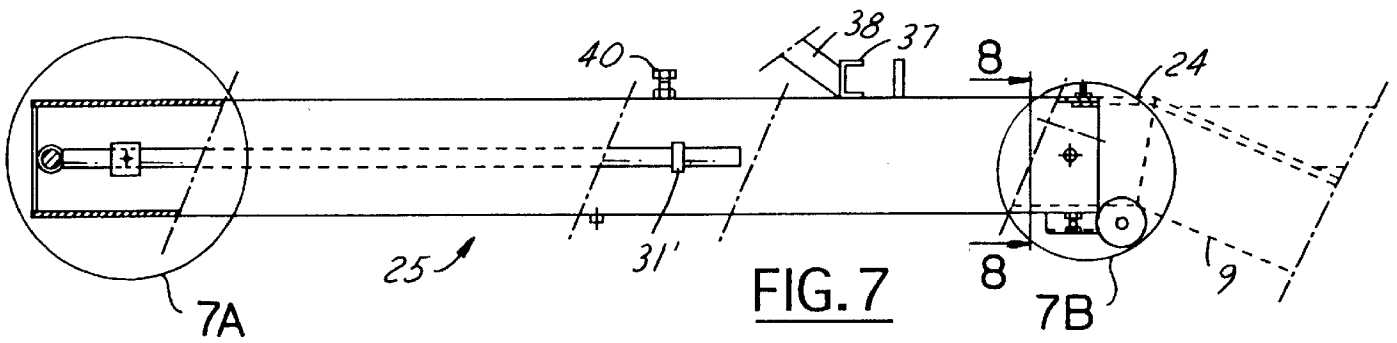

FIG. 7, in similar manner as FIG. 5, represents an outer tube broken away at these places to show the interior structure.

Figure 7B:
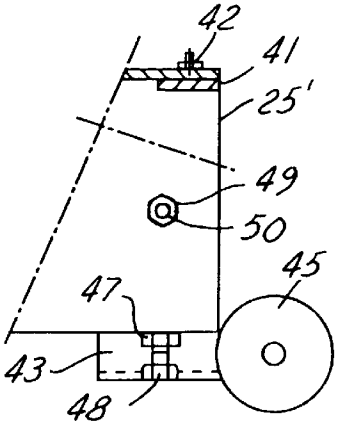
Figure 7A:
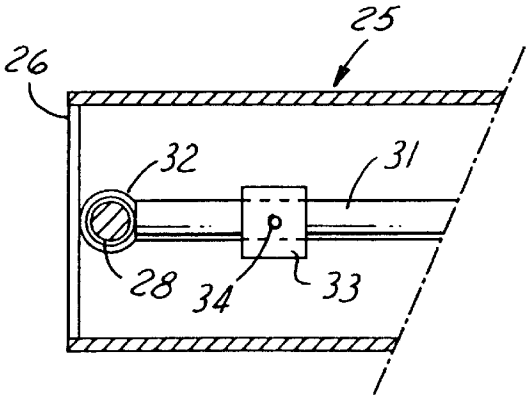

FIGS. 7A and 7B show details A and B, respectively of FIG. 7 on an enlarged scale.

Figure 8:
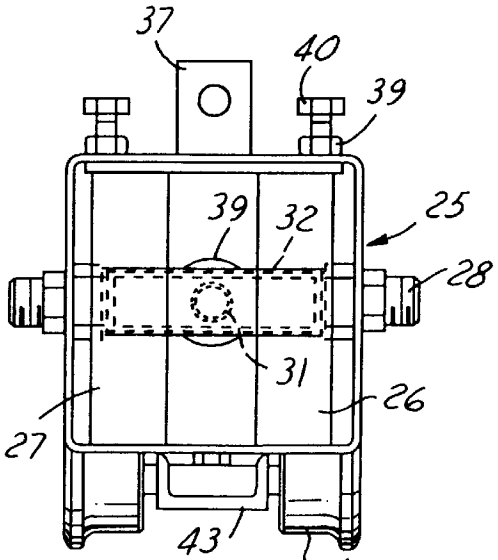

FIG. 8 is an end view as seen from the left in FIG. 7, or FIG. 7A respectively.

Figure 9:
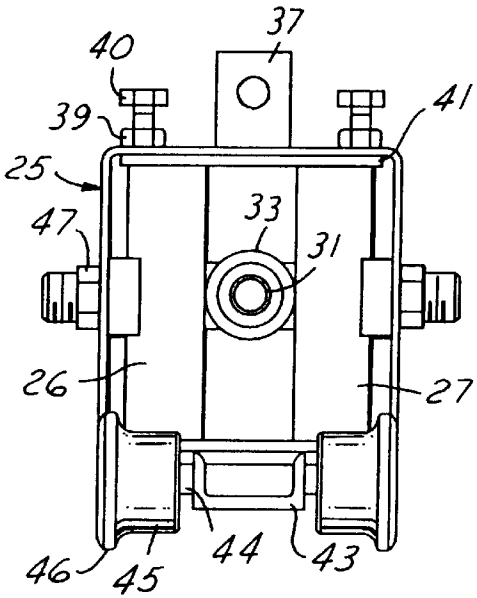

FIG. 9 is an end view as seen from the right in FIG. 7, or FIG. 7B, respectively.

Figure 10:
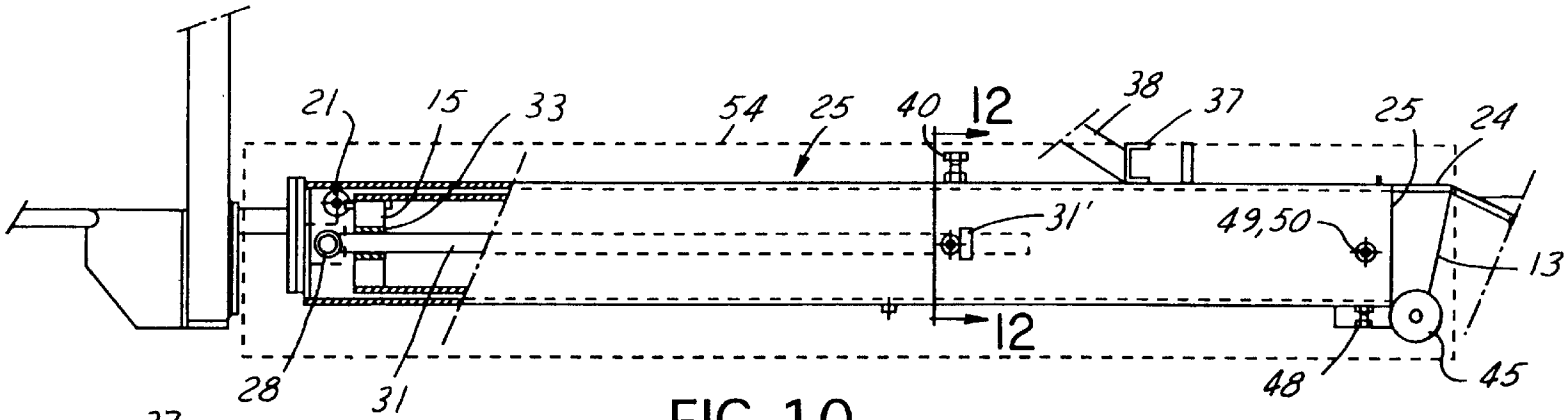

FIG. 10 represents, in partial view, the beam according to the invention in mounted state with the shorter effective beam length, again partly broken away.

Figure 12:
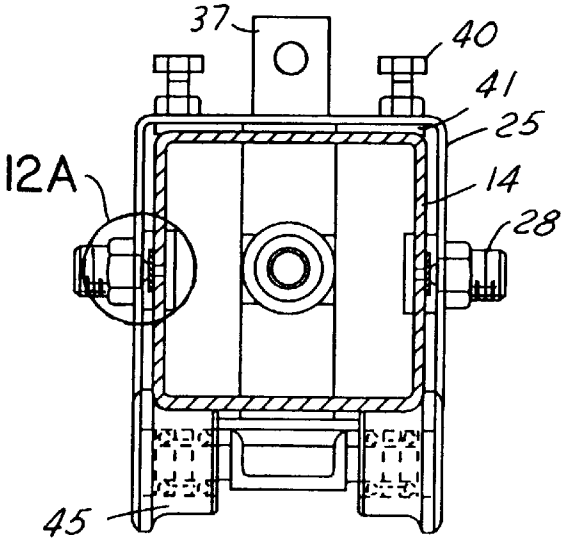
Figure 12A:
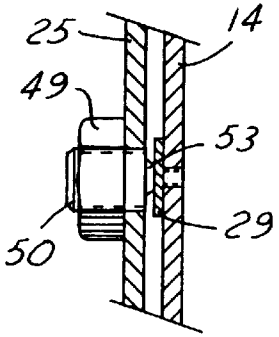
Figure 11:
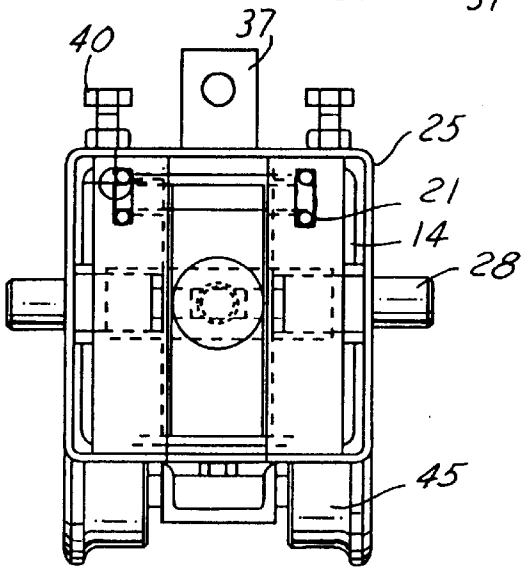

FIGS. 11 and 12 are end views, as seen from the left and from the right, respectively, in FIG. 10, with FIG. 12A being a detail of FIG. 12 on an enlarged scale.

Figure 13:
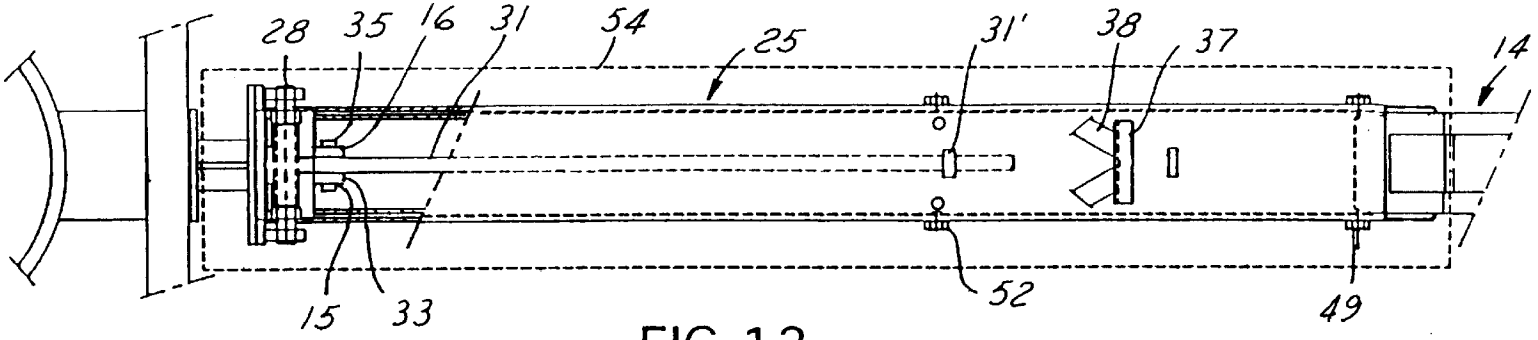

FIG. 13 is a view similar to FIG. 10 but in a view from above.

Figure 14:
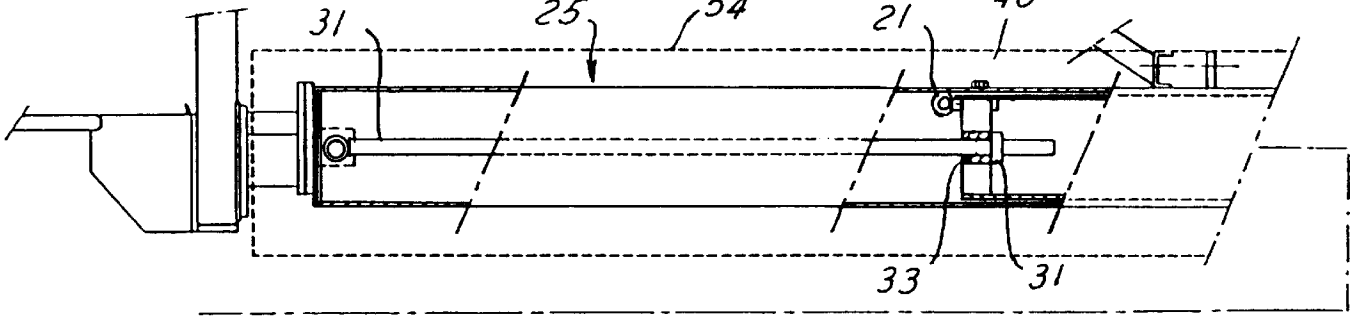
Figure 14:
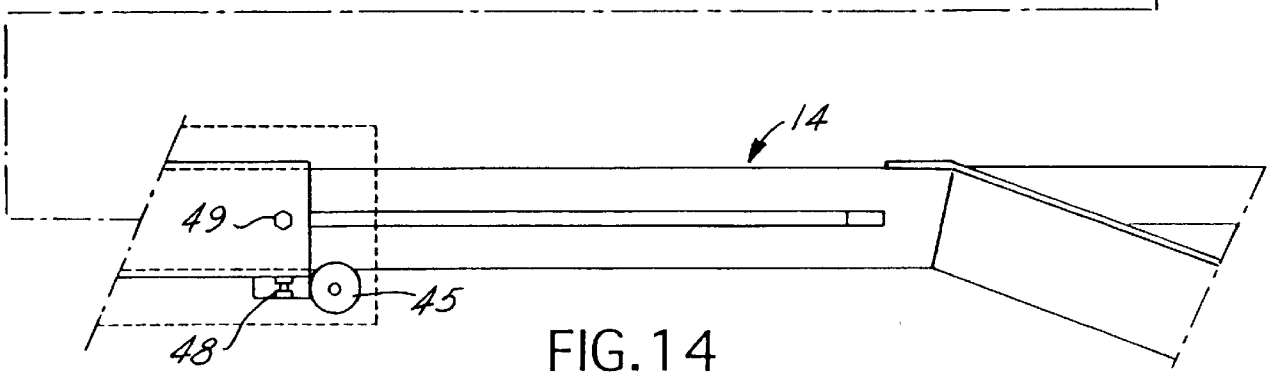

FIG. 14 is a view similar to FIG. 10 but in the position with the longer effective beam length.

Figure 15:
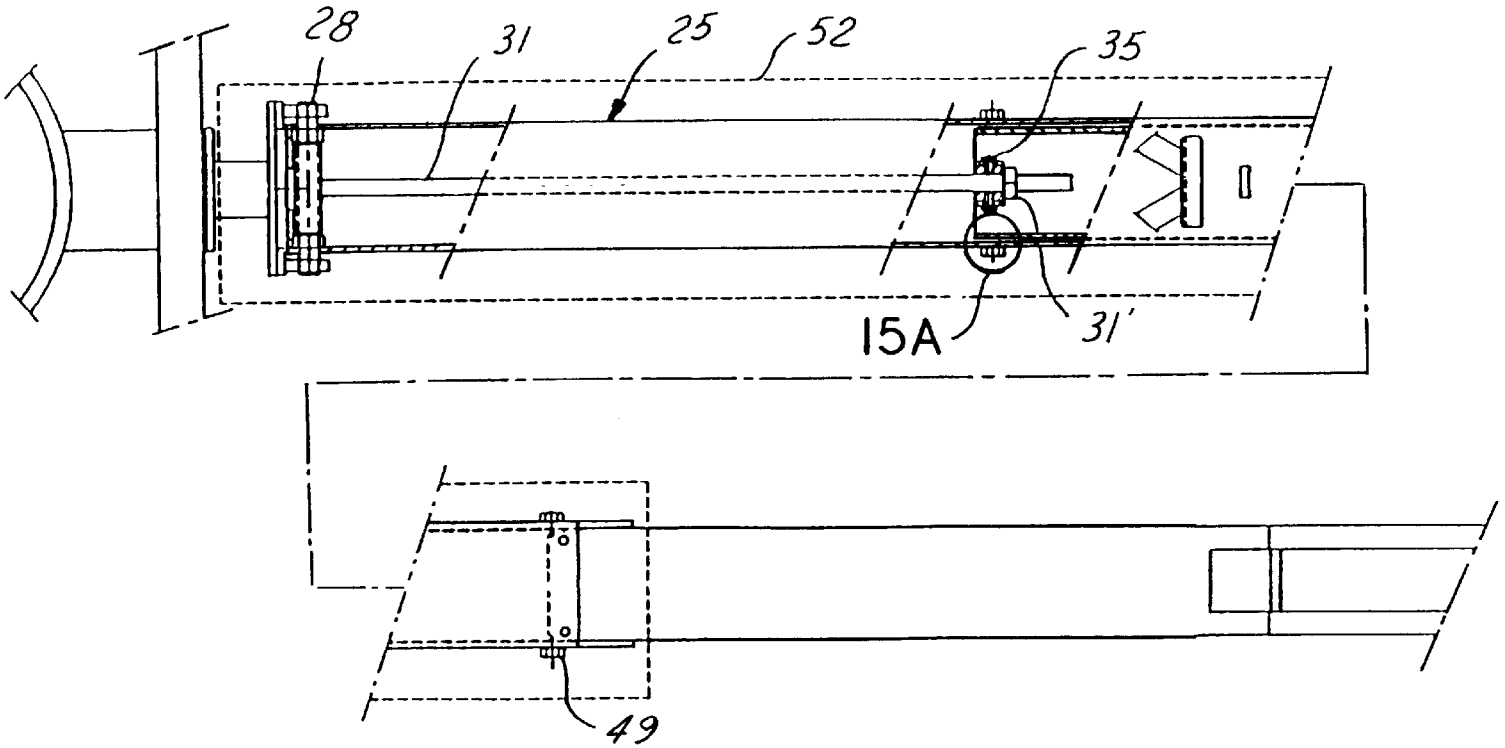
Figure 15A:
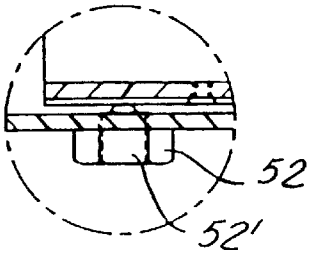

FIG. 15 is a view similar to FIG. 13, with the longer effective beam length as viewed from above with FIG. 15A being a detail on an enlarged scale.

DESCRIPTION OF THE PRIOR ART

Figure 1:
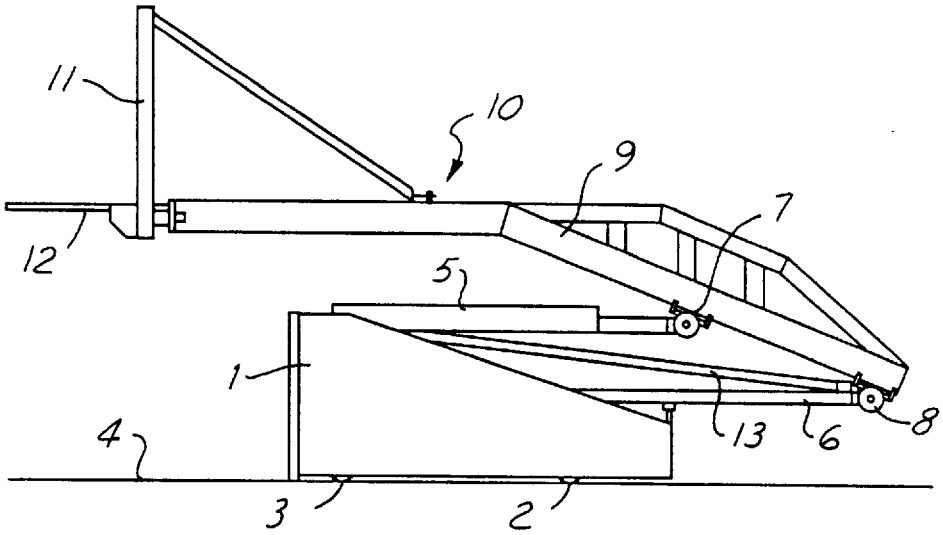

The main structural elements of the basketball-stand, and the manner in which they cooperate, appear from the diagrammatic representation of FIG. 1. A base is designated by 1, the frame of which carries a pair of rear wheels 2 and a pair of front wheels 3, by which the stand is capable of rolling over floor 4.

The base further comprises front and rear lower bearings respectively. Front pivot pins and rear pivot pins carried by these bearings—not represented because they are hidden from view inside the base—enable a front joke 5 and a rear joke 6, respectively, to pivot with respect to base 1.

The opposite ends of jokes 5 and 6 are similarly capable of pivoting, in bearings 7 and 8, respectively, fixedly attached to a beam element 9 which constitutes part of what is called the beam 10 of the stand. Beam 10, at its far end, is provided with means for attachment of the back-board 11 and the dunk ring 12.

Figure 3:
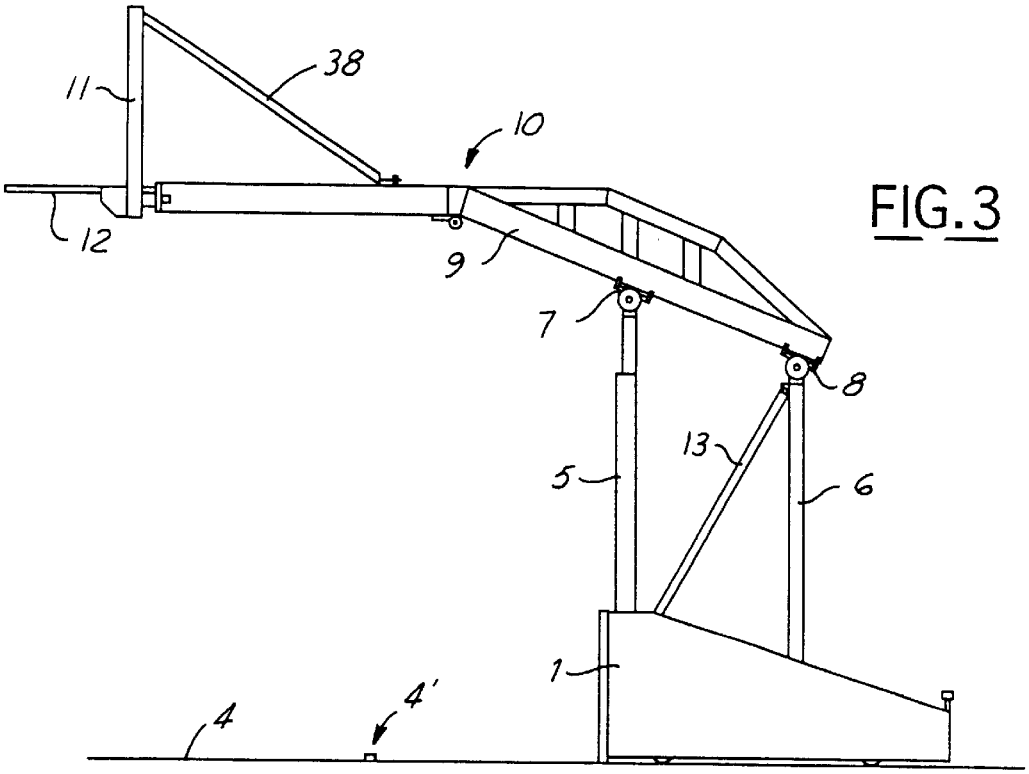
FIG. 3 represents the basketball-stand of the invention in its playing position with the shorter effective beam length.
Figure 4:
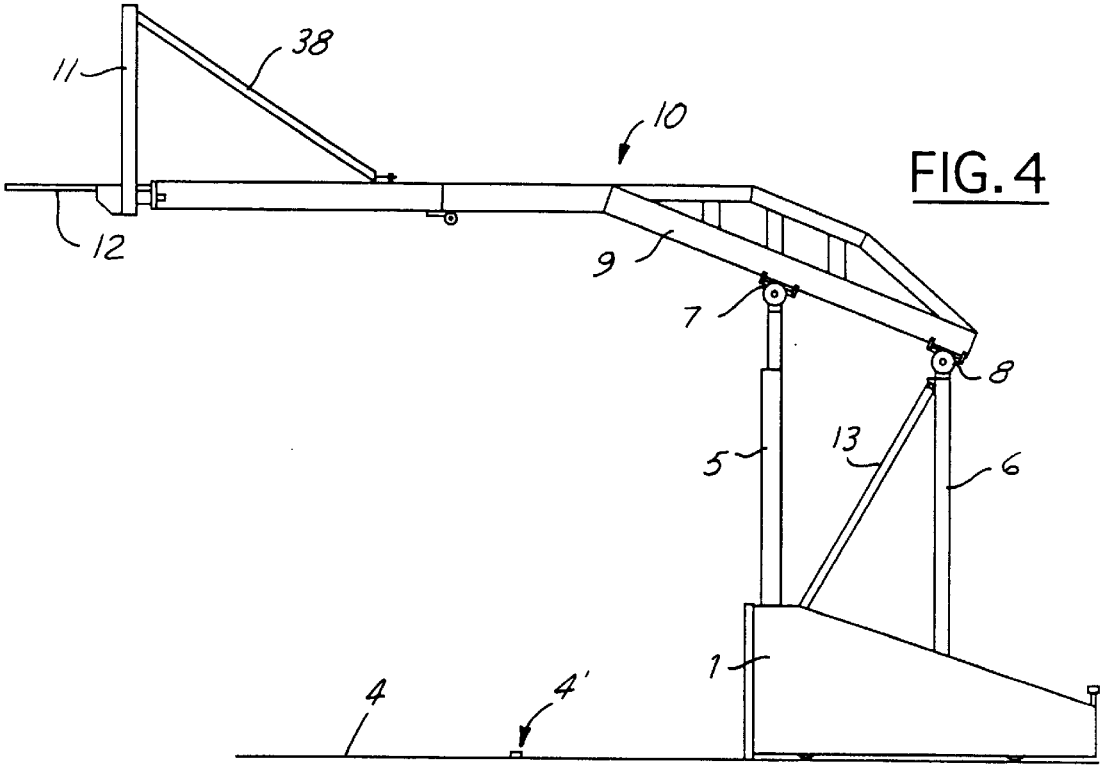
FIG. 4 represents the same but with the longer effective beam length.

Returning to the pivoting system: the four pivot axes of the respective pivot pins are all parallel to one another, oriented perpendicularly to the sheet of the drawing, so that jokes 5, 6, the part of the base between the lower pivot pins, and the part of beam element 9 between the pivot pins supported by bearings 7, 8, form a quadrangular system of links which allows beam 10 to move with respect to base 1, from the position of FIG. 1—the storage postion—to the positions like those of FIGS. 3 and 4—the playing position—which will be discussed in detail below. Diagonally arranged between the jokes inside the system of links is a telescoping rod 13 wich can be used to stabilize the system of rods both in the storage position and in the playing position.

The basketball-stand in the embodiment described so far—which has a relatively short effective beam length—has been widely in use and is therefore generally known. Equally known is an embodiment with a longer effective beam length.

DESCRIPTION OF THE PREFERRED EMBODIMENT

Figure 2:
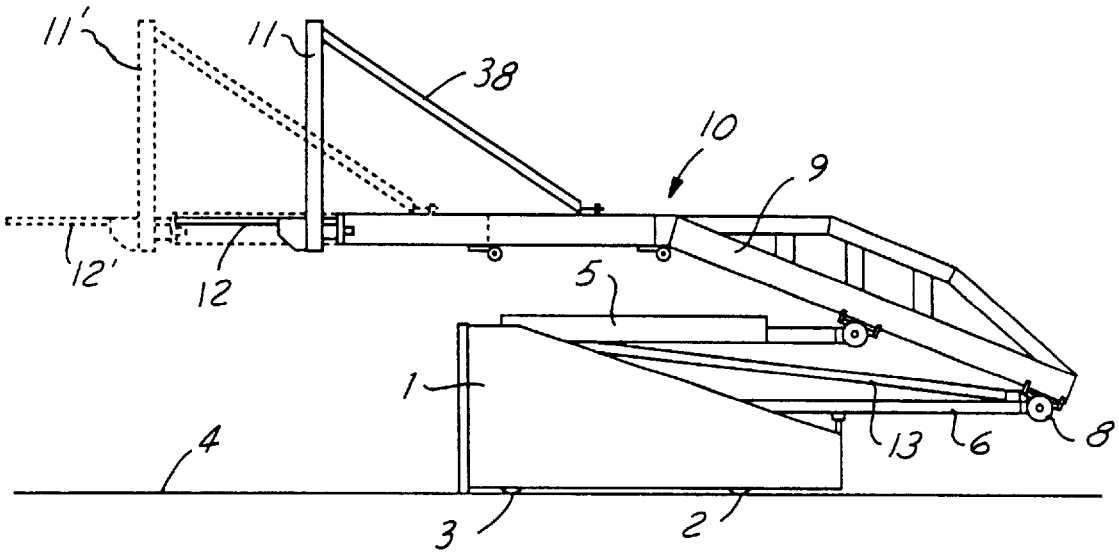

FIG. 2 shows a basketball-stand according to the invention in which beam 10 is realized in such manner that it obtains two effective lengths, a shorter length represented with uninterrupted lines and corresponding to the effective beam length in the prior embodiment of FIG. 1, and an extended or longer length, resulting in a position of the back-board and the dunk ring as represented in broken lines and indicated by 11' and 12', respectively.

FIG. 3 represents the stand of FIG. 2 in playing position with the shorter beam length, and FIG. 4 represents the stand in playing position with the longer beam length. In these figures the field line is indicated by 4'.

For the manner in which the extendability of beam 10 is structurally obtained, reference is made to the further figures.

Figure 6:
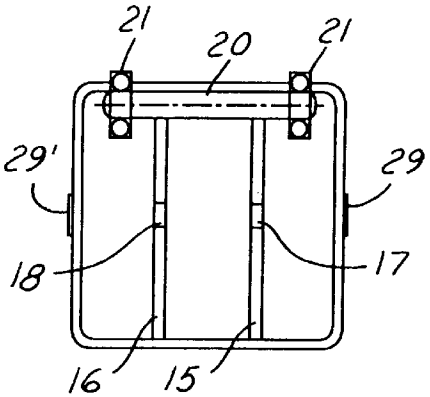
FIG. 6 is an end view, as seen from the left in FIG. 5, or 5A, respectively.
Figure 5A:
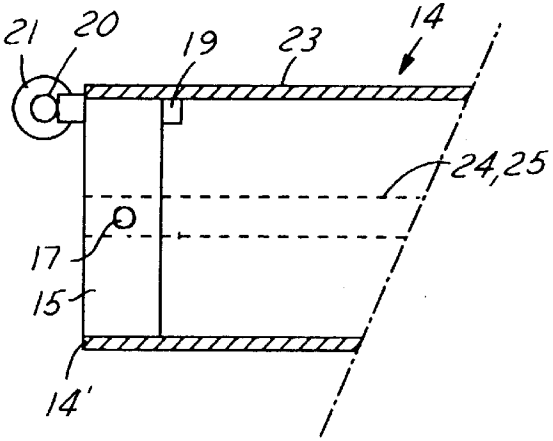

As is shown in FIGS. 5, 5A and 6, beam 10 comprises, attached to the element 9 thereof to which the bearings 7, 8 for the upper pivots of the support system are connected, an inner tube 14 which, in this embodiment, has a square cross-section. Inner tube 14 is fixedly connected to beam element 9 such as by a weld 13.

Near the open far end 14' of tube 14 two vertical plates 15, 16 of rectangular are fixedly attached preferably by welding between the top and bottom of inner tube 14. Plates 15, 16 are each provided with an aperture 17, 18 for a purpose to be explained below.

Attached against the top wall of tube 14 is a support block 19 of a sufficient length to be stably attached against upper tube wall as is shown in FIG. 5A, and also projecting a certain distance beyond the end 14' of tube 14. There it carries an axis 20 for a pair of rollers 21, 22 on either side. Rollers 21, 22 in this embodiment are ball bearings the outer rings of which are cylindrical and serve as rolling surfaces. They have such a diameter that the circumferential surface thereof lies just above the outer surface 23 of upper tube wall.

Lengthwise on either side of tube 14 the tube carries a strip 29, 29'.

On top of inner tube 14 an abutment strip 24 is affixed such as by welding. It is situated rather close to the end which is welded, at 13, to beam element 9, and it may, as in this embodiment, extend partly over beam part 9.

Then there is an outer tube 25, depicted in elevational view in FIG. 7 with details A and B shown enlarged a FIGS. 7A and 7B respectively. The end views are shown in FIGS. 8 and 9. Outer tube 25 has the same cross-sectional profile as inner tube 14 but is of slightly greater dimensions than those of inner tube 14, so that outer tube 25 can slide, with some clearance, over inner tube 14.

One end 25' of outer tube 25, to wit the right hand end (FIG. 7B), is open, and in the opposite end two welded plates 26 and 27 are provided. The outside of plates 26 and 27, as well as a bolt 28, can be used for attachment, in a manner which may be identical to the state of the art, of the back-board and the dunk ring.

Inside outer tube 25 there is a round tube or rod 31 which has been welded, at one end, to a piece of tube 32. The inner diameter of tube 32 is such that it fits loosely around bolt 28. During mounting, parts 31, 32 are kept in place by hand so that bolt 28 can be put through.

Loosely fitting around tube or rod 31 is a bush 33 with diametrically arranged threaded bore holes 34.

Bush 33 is meant to be placed, during mounting, between plate 15 and 16 at the end of inner tube 14 (see FIG. 6) so that a fixation bolt can be inserted through each of bores 17 and 18 and threaded into a threaded hole such as 34 in bush 33.

The mounted condition is visible in FIG. 13 where one of the fixation bolts is indicated by 35.

FIG. 7 in its centre shows that near the other end, rod or tube 31 carries an abutment ring 31'.

On top of outer tube 25 attachment means 37 are provided which serve to attach, in known manner, stabilisation elements 38 for back-board 11.

Also on top of outer tube 25 a pair of nuts such as 39 is welded, at the location of a borehole (not shown) in the upper web of outer tube 25 corresponding to or slightly bigger in diameter than the outer diameter of the screw-thread in nut 39. This enables a bolt 40 to be threaded in, which will be urged against inner tube 14 and serves to prevent relative sliding movement of tubes 14 and 25.

Near the open end 25' of outer tube 25, an abutment strip 41 is attached, such as by screws and bolts 42, against the top wall. This strip 41 will fill any clearance in vertical direction between inner tube 14 and outer tube 25 and enable abutment of the open end 25 of the outer tube against abutment strip 24 on top of inner tube 14 (see FIG. 5).

Also near the open end 25' and fixed against the outside of the bottom web 35 thereof is a support block 43 (see also FIG. 9) which, just like support block 20, is of sufficient length to be stably attached to the tube and to project slightly beyond end 25' of outer tube 25 where it carries, by means of an axis 44, a pair of rollers such as 45. Roller 45 in this case are of the type presenting flanges 46 in the same manner as wheels of rail running vehicles. The lateral distance of the two rollers or wheels 45 is such that the distance between the insides of the flanges corresponds to the lateral dimension of inner tube 14. In this way, during the relative sliding movement of inner tube 14 and outer tube 25, wheels 45 will support inner tube 14 in vertical direction and in a lateral direction, as is illustrated in further figures.

Welded against the bottom web of tube 25, on either side of wheel support block 43, are two nuts such as 49, with co-operating bolts such as 48, fulfilling the same function as the nuts and bolts 39, 40 on top: prevent relative sliding movement of tubes 14 and 25.

Again near the open end 25' each of the side walls of outer tube 25 carries a nut such as 49 welded thereto. Each nut such a 497 serves to accomodate an adjustable ball pressure mechanism 50, details of which will be shown in further figures. The balls of these mechanisms are resiliently urged against strips 29, 29' on the inner tube.

FIGS. 10–13 depict inner tube 14 and outer tube 25 slid one into the other as far as possible. One can see that open end 25' of outer tube 25 abuts against abutment element 24 which is carried by inner tube 14. This is the position of shortest overall length, and therefore the shortest beam length position. Rollers 45 are situated between tube end 25' and the region of weld 13. At the broken away place at the left it is visible that rollers 21 rest against the inside of the upper web of inner tube 14, which they do under the influence of the momentum resulting from the weight of the back-board and dunk ring.

FIG. 12A shows details yet of the adjustable ball pressure mechanism 49, 50. Unit 50 can be screwed into the thread of nut 49. Unit 50 contains a ball 53 which is under the influence of a spring in the interior, so that it is resiliently urged against strip 29. This mechanism, and a similar one on the other side will guide the relative movement of tubes 14, 25 in lateral direction.

FIG. 14 in similar elevational view as FIG. 13 illustrates the extended position having the greatest effective beam length.

FIG. 15 does the same in a view from above, with FIG. 15A again showing the detail of a ball mechanism 52, 52' at a larger scale. This—together with its counterpart on the opposite side—is arranged in the central region of outer tube 25, where, as FIG. 15A shows, they will provide lateral support when the tubes 14, 25 have been drawn out into their largest position. Inner tube 14 is still supported by rollers 21 which are visible in the partly broken away place in FIG. 14, while the other pair of rollers 45, under the influence of the momentum which in this case is caused by the weight of the extended outer tube and the back-board and dunk ring carried thereby, rest against inner tube 14. This extreme position of greatest effective beam length is determined by the abutment of ring 31' against bush 33, so that it is not possible to draw the outer tube 25 with the back-board entirely off the inner tube 14. The abutment of elements 31' and 33 exactly determines the effective beam length.

A known protective padding can be arranged around the part of the beam 10, which projects into the playing field, as is indicated in broken lines by 54 in FIGS. 12, 13–15. Both in the position of shorter effective beam length and in the one with longer effective beam length, this padding 54 can be arranged around outer tube 25.

In operation, supposing that the stand will be in storage in its storage position, it is first rolled to the playing field. When there is little room available around the field line 4', the stand is simply raised and brought into its playing position with the shorter effective beam length, as shown in FIG. 3. When, to the contrary, there is enough space available around the field line 4', the stand is kept in its storage position. Then the two upper bolts such as 40 and the two lower bolts such as 51 are unscrewed a few windings, sufficient to unlock the inner tube 14 with respect to outer tube 25. Then the outer tube is pulled out, for example by pulling backboard 11, into the position presenting the greater effective beam length such as shown in broken lines in FIG. 2. As stated, this position is determined by abutment of abutment elements 31' and 33. The bolts 40 and 51 are screwed in again so as to lock inner tube 14 with respect to outer tube 25. In this condition the stand is brought into its playing position, now the one which is shown in FIG. 4.

It will be clear that numerous variations on the basic idea of the invention are feasible. The two beam parts which are movable one with respect to the other need not be slidable; one part may be pivotably adjustable with respect to the other, resulting in a different effective beam length. The two parts need not be tubes; they could well be, for example, U-shaped profiles.

What is claimed is:

1. A basketball stand comprising, in combination:

a base;

at least one support system carried by the base;

a beam provided with means for attachment of a back-board and dunk-ring;

said beam having inner and outer relatively slidable tubes;

said inner tube being provided exteriorly with a stop member for abutment of the outer tube to define one extreme relative position of the inner tube with respect to the outer tube corresponding with the shortest effective beam length; and said inner tube at a short distance spaced from its free end having interiorly an abutment member for abutting a further stop member carried by the outer tube to define a second extreme relative position of the inner tube with respect to the outer tube, corresponding with the greatest effective beam length.

2. A basketball-stand defined in claim 1, wherein said inner tube, at a small distance from its free end having an interior abutment member for a further stop member carried by a rod or tube element inside the outer tube, which rod or tube element is attached to an end plate which in turn is attached to the end of said outer tube which carries the means for attachment of the back-board and dunk ring.

3. A basketball-stand defined in claim 1, wherein said outer tube at its end opposite the end which carries the means for attachment of a back-board and dunk ring being provided with roller means adapted to ride against the outside of said inner tube, the latter, at its free end, being provided with roller means adapted to ride against the inside of said outer tube.

4. A basketball-stand defined in claim 1, wherein said inner tube and said outer tube have rectangular cross sections, said outer tube at or near its end opposite the end which carries the means for attachment of a back-board and dunk ring being provided and at the lower web thereof, with roller means comprising a pair of flanged rollers adapted to ride against the lower corner regions at the outside of said inner tube, the latter, at its free end, being provided with roller means adapted to ride against the inside of said outer tube.

5. A basketball-stand defined in claim 1, wherein said inner tube and said outer tube have rectangular cross sections, and said outer tube at or near its end opposite the end which carries the means for attachment of a back-board and dunk ring, and attached to the side webs of its tubular profile, being provided with inwardly projecting ball shaped rolling guide means contacting a strip shaped region at the outside of the inner tube.

6. A basketball-stand as defined in claim 1, wherein said outer tube and said inner tube have rectangular cross sections, and said outer tube at or near its end opposite the end which carries the means for attachment of a back-board and dunk ring, and attached to the side web of its tubular profile, being provided with ball-shaped rolling means projecting inwardly over an adjustable distance and contacting a strip shaped region at the outside of the inner tube.

7. A basketball-stand comprising:

a base;

a beam having means at one end for supporting a back-board and dunk ring;

a support system carried by the base for supporting the beam and for raising and lowering the beam; and said beam shiftable horizontally on said support system to extend and retract said means farther from or closer to said base without changing the height thereof;

said beam comprises a first beam part and a second beam part mounted to each other such that the first beam part retracts and extends with respect to the second beam part; and a means for defining two extreme relative positions of said beam with respect to said base.

8. The means as recited in claim 7, further comprising:

a stop element carried by one of the beam parts, for abutment with the other beam part to define one extreme relative position of the first beam part and the second beam part, corresponding with the shortest effective beam length;

an abutment member carried by one of the beam parts for abutment with a further stop member carried by the other beam part, to define another extreme relative position of the first beam part and the second beam part, corresponding with the greatest effective beam length.

9. The means as recited in claim 7, further comprising:

an end plate fixed near the free end of the first beam part for carrying the means for attachment of a back-board and dunk ring; and a rod element carried by said end plate wherein the rod element is disposed longitudinally with respect to the first beam part, and the rod element having a stop element for abutment with the second beam part.

10. The beam as recited in claim 7, wherein:

said second beam part having at least one roller adapted to ride against the first beam part to facilitate movement between the first beam part and the second beam part; and, a second roller carried by the first beam part, adapted to ride against the second beam part to further facilitate movement between the first beam part and the second beam part.

11. The beam as recited in claim 7, wherein:

said first beam part having a depression formed in the first beam part; and said second beam part having a sphere-like rolling guide projecting inwardly from the second beam part wherein the rolling guide rides against the depression of the first beam part such that the first beam part retracts and extends with respect to the second beam part.

12. The beam as recited in claim 7, further comprising:

a second beam part;

a first beam part horizontally shiftable with respect to the second beam part, and the first beam part having a means for attaching the back-board and dunk ring; and a rolling means carried by the first beam part near the end closest to the base, wherein the rolling means projects inwardly over an adjustable distance;

a depression formed in the second beam part wherein the rolling means contacts the depression.

13. The support system as recited in claim 7, further comprising:

at least two members carried by the base wherein the members pivot about the base, and the members carry the beam; and a link pivot at one end of each of the beams in order to permit the beam to remain in fixed horizontal position as the vertical position of the beam increases.

* * * * *